United States Patent [19]

James

[11] Patent Number: 4,991,331

[45] Date of Patent: Feb. 12, 1991

[54] DISPLAY ASSEMBLY

[75] Inventor: Roger A. James, Burton-on-Trent, England

[73] Assignee: R. A. James & Co. Limited, England

[21] Appl. No.: 419,665

[22] Filed: Oct. 11, 1989

[30] Foreign Application Priority Data

Oct. 22, 1988 [GB] United Kingdom ..... 8824812

[51] Int. Cl.[5] ..... G09F 13/00

[52] U.S. Cl. ..... 40/443; 40/442; 40/900; 40/219; 272/8 M; 272/8.5

[58] Field of Search ..... 40/900, 577, 540, 442, 40/443, 444, 427, 452, 219; 350/4.1; 272/8 R, 8 M, 8 N, 8 F, 8 D, 8 P, 8.5, 9–13; 273/143 R

[56] References Cited

U.S. PATENT DOCUMENTS 1,266,014 5/1918 Gribble et al. ..... 40/442
1,473,939 11/1923 Russell ..... 272/8 R
1,729,472 9/1929 Behning ..... 272/8 M
4,180,931 1/1980 Osch ..... 40/219
4,700,948 10/1987 Okada ..... 273/143 R

FOREIGN PATENT DOCUMENTS 647436 11/1928 France ..... 40/443

*Primary Examiner*—Peter R. Brown
*Assistant Examiner*—James Gardner
*Attorney, Agent, or Firm*—W. Thad Adams, III

[57] ABSTRACT

A display assembly 10 for mounting in a fruit machine comprises an open topped housing 14. A pair of two-way mirrors 20*a*, 20*b* are joined at right angles to one another with their mirrored sides defining the included angle and facing towards the housing's opening. A visual representation 21*a*, 21*b* is printed on the reverse side of each mirror and is visible through the respective mirror when lamps 22 therebehind are lit, with a mirror image of the representation visible reflected from the other mirror.

10 Claims, 1 Drawing Sheet

DISPLAY ASSEMBLY

BACKGROUND OF THE INVENTION

This invention relates to a display assembly, and is particularly concerned with assemblies for use with amusement machines known as "fruit machines" or slot machines wherein a number of features are selectively required to be displayed to the player of the machine.

SUMMARY OF THE INVENTION

According to the present invention there is provided a display assembly comprising a housing having a side through which the housing can be viewed internally, a pair of two-way mirrors arranged in a substantially right-angled relationship and mounted in the housing with the mirrored sides defining the included angle and facing towards the viewing side, each mirror having a visual representation on the other side thereof, and a lamp located behind said other side of each mirror, whereby when one of the lamps is lit, the respective representation is visible through the respective mirror and the mirror image of the same representation is visible on the other mirror.

Preferably the viewing side is defined by a window, and a tint may be provided on the inside surface of the window whereby the mirrors are not visible when the lamps are unlit.

Each mirror may be formed on a plastic (PERSPEX) sheet and a plurality of lamps may be provided behind each mirror. The window may comprise a sheet of glass and the tint may comprise a sheet of plastic (PERSPEX).

The visual representations on each mirror are preferably different. Each representation preferably shows a half of a substantially symmetrical object divided along its axis of symmetry whereby, when the or each lamp behind one of the mirrors is lit, an image of the whole of one object is visible, and when the or each lamp behind the other mirror is lit, an image of another object is visible at the same location.

One of the representations may show the top or bottom half of the back of a playing card and the other may show the top or bottom half of the front of a picture playing card.

An embodiment of the present invention will now be described by way of example only with reference to the accompanying drawings in which:

DETAILED DESCRIPTION

Figure 1:
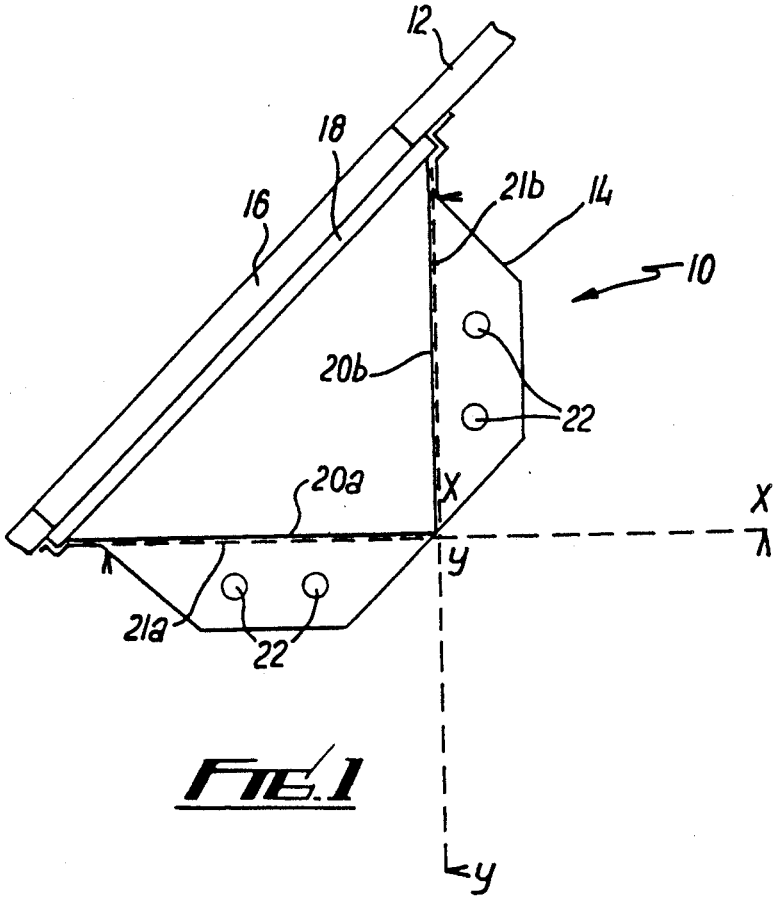
FIG. 1 is a diagrammatic side view of an assembly according to the invention.

Referring to FIG. 1 of the drawings a display assembly 10 is mounted on a display panel 12 of a fruit machine. The assembly 10 comprises an open-topped housing 14 with a substantially U-shaped cross-section and a window 16 extending across the open top thereof. The window 16 may be formed of glass and a tint may be provided on the inside surface thereof in the form of a layer 18 of plastic (PERSPEX).

A pair of two-way mirrors 20*a*, 20*b* are joined at right angles to one another and so mounted within the casing 14 that each extends, from a respective outer edge of the window 16 to the base of the casing 14. The mirrors

20*a*, 20*b* may be formed for example on 3 mm thick plastic (PERSPEX) and have their mirrored side facing outwardly from the casing 14.

A visual representation 21*a*, 21*b* is printed on the reverse side respectively of each mirror 20*a*, 20*b* and is visible through the respective mirror when light is shone from the back thereof. In this example the representation 21*a* is the top half of the back of a playing card, and the representation 21*b* is the top half of the face of a picture playing card, for example the Queen of Hearts. Two lamps 22 are provided between each mirror 20*a*, 20*b* and the respective wall of the casing 14.

In use, when neither pair of lamps 22 is lit, no image is seen through the window 16 and the tint 18 prevents the mirrors 20*a*, 20*b* from being visible. When the lamps 22 behind mirror 20*a* are lit, a real image of half of the back of a playing card is seen through the mirror 20*a* and a virtual mirror image X—X of half a playing card back is visible reflected from mirror 20*b*. Similarly when the other pair of lamps is lit a real image of the top half of the Queen of Hearts is shown through the mirror 20*b* and a virtual mirror image Y—Y of half of the Queen Hearts is visible reflected from mirror 20*a*. Therefore in both instances the appearance of a whole card is given at the same location, and switching between the pairs of lamps gives the impression of the card being turned over.

Figure 2:
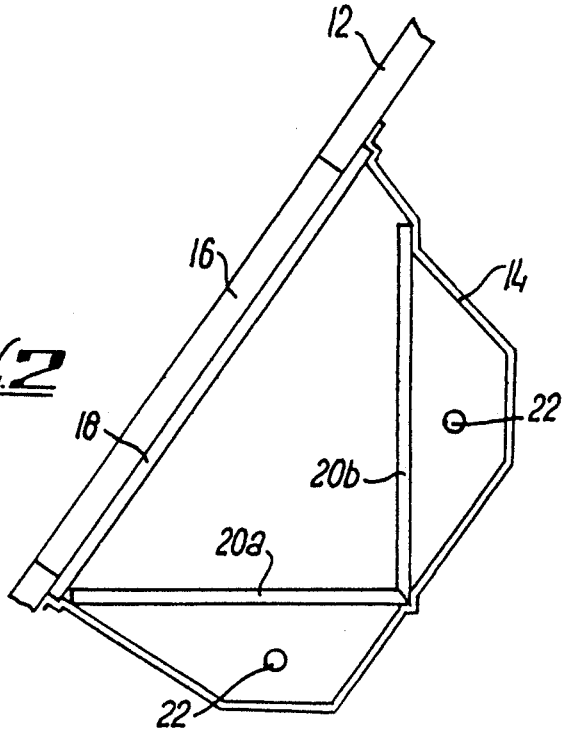
FIG. 2 is a side view of a modification to the assembly shown in FIG. 1.

FIG. 2 shows a similar assembly to that shown in FIG. 1 except there is a change in the position of the mirrors 20*a*, 20*b* relative to the window 16 whereby the image provided by the assembly is directed at a different angle towards a player of the machine. The casing 14 has been modified accordingly.

There is thus provided a display assembly which allows one of two representations to be visible at a single location. Furthermore by rapid switching between the representations an effect of movement can be produced. The assembly is of relatively simple construction and can thus be inexpensively manufactured. The assembly is relatively compact and has no moving parts so can thus be operated virtually maintenance free.

Various modifications may be made without departing from the scope of the invention. For example the mirrors may be differently aligned relative to the window. A different number of lamps could be provided for each mirror. The mirrors could be manufactured in a different form as could the casing. It is to be understood that representations of many different objects could be provided on the mirrors. It would be possible to provide representations of the same object but at different orientations or different colour representations of the same object, to give the impression of movement or of changing of colour.

I claim:

1. A display assembly comprising a housing:

a side of said housing through which said housing can be viewed internally, a pair of two-way mirrors arranged in a substantially right-angled relationship and mounted in said housing with the mirrored sides defining the included angle and facing towards said viewing side, a visual representation on said other side of each mirror, and a lamp located behind said other side of each mirror, whereby when one of said lamps is lit, the respective representation is visible through the respective mirror and the mirror image of said same representation is visible on the other mirror.

2. An assembly according to claim 1, in which a window defines said viewing side.

3. An assembly according to claim 2, in which said window comprises a sheet of glass.

4. An assembly according to claim 2, in which a tint is provided on the inside surface of said window whereby said mirrors are not visible when said lamps are unlit.

5. An assembly according to claim 4, in which said tint comprises a sheet of plastic.

6. An assembly according to claim 1, comprising plastic sheet upon which each said mirror is formed.

7. An assembly according to claim 1, in which a plurality of lamps are provided behind each said mirror.

8. An assembly according to claim 1, in which said visual representations on each said mirror are different.

9. An assembly according to claim 8, in which each said representation shows a half of a substantially symmetrical object divided along its axis of symmetry whereby, when the or each said lamp behind one of said mirrors is lit, an image of the whole of one object is visible, and when the or each said lamp behind said other mirror is lit, an image of another object is visible at the same location.

10. An assembly according to claim 9, in which one of said representations shows a half of the back of a playing card and said other shows a half of the front of a picture playing card.

* * * * *